US005468912A

United States Patent [19]

Zalewski

[11] Patent Number: 5,468,912

[45] Date of Patent: Nov. 21, 1995

[54] SWIVEL ASSEMBLY FOR MULTI-CONDUCTOR CORD

[76] Inventor: Leon Zalewski, P.O. Box 280676, East Hartford, Conn. 06128

[21] Appl. No.: 237,192

[22] Filed: May 3, 1994

[51] Int. Cl.[6] ..... H01R 39/00

[52] U.S. Cl. ..... 174/86; 174/91; 439/21; 439/22; 439/24

[58] Field of Search ..... 174/86, 91; 439/13, 439/20, 21, 22, 24

[56] References Cited

U.S. PATENT DOCUMENTS

| | | | |
|---|---|---|---|
| Re. 32,805 | 12/1988 | Engelmore et al. | 439/26 |
| 3,181,100 | 4/1965 | Rogers . | |
| 3,585,564 | 6/1971 | Skjervoll | 285/279 |
| 4,533,796 | 8/1985 | Engelmore | 179/186 |
| 4,583,798 | 4/1986 | Blazowich . | |
| 4,590,337 | 5/1986 | Engelmore | 179/186 |
| 4,592,605 | 6/1986 | Kapler . | |
| 4,673,228 | 6/1987 | Ditzig | 439/21 |
| 4,773,866 | 9/1988 | Basques | 439/21 |
| 5,114,352 | 5/1992 | Gahagen et al. | 439/22 |

*Primary Examiner*—Morris H. Nimmo
*Attorney, Agent, or Firm*—McCormick, Paulding & Huber

[57] ABSTRACT

A swivel assembly for eliminating undesirable loops in an electrical or telephone cord has half shells provided in axial alignment and surrounding an inner core. The inner core defines slip rings for electrically engaging complementary cavities in the shell so as to afford electrical connection between the plurality of electrical conductors within the cord.

3 Claims, 1 Drawing Sheet

SWIVEL ASSEMBLY FOR MULTI-CONDUCTOR CORD

CROSS REFERENCE TO PRIOR PAPERS FILED AT U.S. PATENT AND TRADEMARK OFFICE

Applicant filed papers purporting to be a patent application on Jan. 27, 1994 and identified by No. 08/205242 in a notice dated Mar. 29, 1994. This application is a refiled application directed to the same subject matter disclosed in the papers filed Jan. 27, 1994.

BACKGROUND OF THE INVENTION

This invention relates generally to providing a solution to the problem of conventional electrical and telephone cords tending to form undesirable loops due to the internal twisting of the conductors within the cord and due to the peculiarities of some multi-conductor cord applications such as the conventional hand held telephone receiver cord which during use tends to form such loops.

SUMMARY OF THE INVENTION

In accordance with the present invention a swivel assembly is provided for a multi-conductor cord and comprises a pair of outer shells that have aligned axes and each shell includes at least one central conductor terminal and at least one annular terminal that is spaced radially and axially from the central conductor terminal. These conductor terminals are electrically connected to corresponding conductors of the cord, and the pair of shells is provided with one or more additional annular terminals for other cord conductors, said additional annular terminals also being radially and axially spaced from the above mentioned conductor terminals, and from each other.

A core is rotatably received inside these shells and on the aligned shell axes and has a central conductive element electrically connecting the central conductor terminals of the shells. This core also has at least one conductor element spaced radially from a central conductive element, and conductive annular slip rings are electrically connected to the opposite ends of said at least one conductive element for mating with said annular terminals during rotational movement of the core relative to the shells. As so constructed and arranged the shells with their cords attached are rotatable on the core and the core is rotatable within the shells. This swivel action avoids the propensity for the electrical cord to form undesirable loops either during use or due to the internally twisted conductors in the cord itself.

The principal object of the present invention is to provide a swivel assembly on an otherwise continuous electrical cord or telephone line that is designed to resist any torsional load being transmitted from one segment of the cord to an adjacent segment such as can sometimes tend to form undesirable loops in the cord.

DETAILED DESCRIPTION

Figure 1:
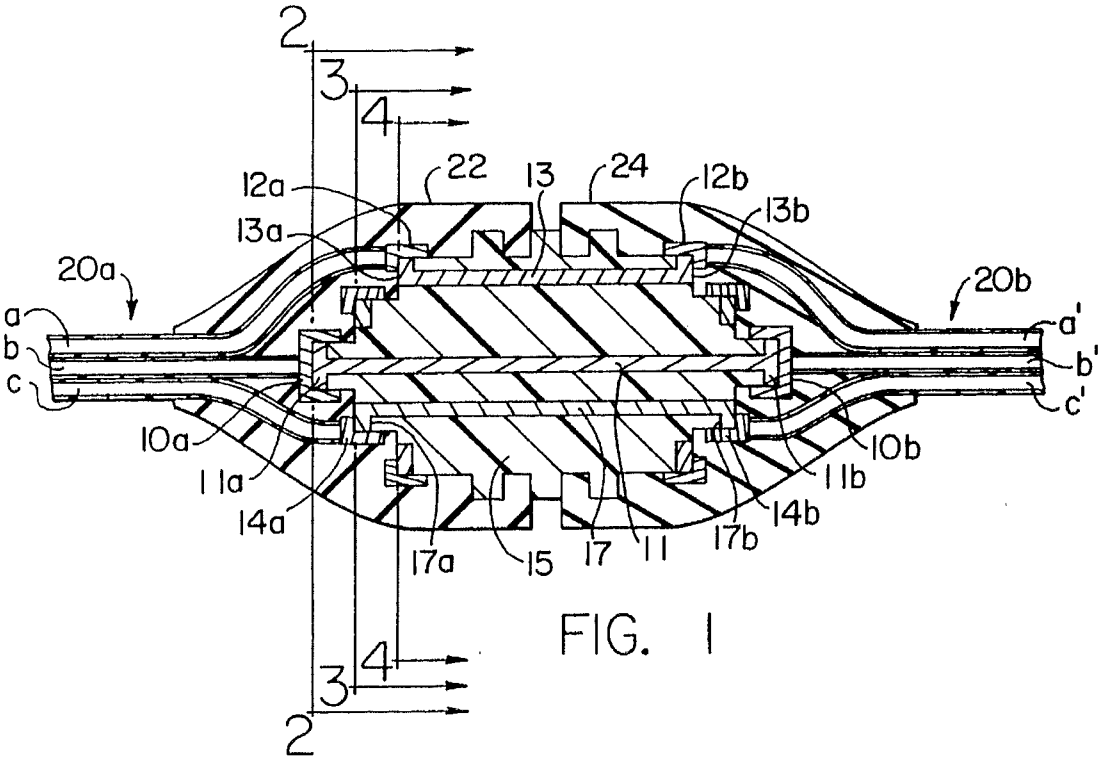
FIG. 1 is a vertical section taken through a swivel assembly constructed in accordance with the present invention.

Turning now to the drawings in greater detail, FIG. 1 illustrates a multi-conductor cord of the type formed from twisted wire or otherwise exhibiting an undesirable tendency to form loops and to twist. The cord has been illustrated in segments 20*a* and 20*b* with a swivel assembly provided between these segments in accordance with the present invention.

Typically, each cord segment 20*a* has a plurality of individual conductors a, b and c that are to be electrically connected to the corresponding conductors a', b' and c' of the other cord segment 20*b*. In accordance with the present invention a molded plastic swivel assembly is provided with a pair of outer shells 22 and 24 fabricated of molded plastic with dielectric characteristics and resistant to environmental conditions. Each outer shell has it's associated conductors a/a', b/b' and c/c' molded therein so that one conductor b/b' is oriented generally axially of the generally ellipsoid shape shown.

This center conductor b is provided with a circular conductor terminal 10*a* that has a concave face so as to receive a complimentary shaped end portion 11*a* of a central conductive element 11 that is provided on the longitudinal central axis of the core 15. The core 15 has a stepped cylindrical external configuration and the shells a stepped internal configuration such that the outer shells 22 and 24 rotate with respect to one another. In the core 15 the central conductive element 11 has a right-hand end portion 11*b* that engages the concave face of conductive terminal 10*b* associated with the central conductor $b^1$ of the cord segment 20*b*. Note the inside and outside corners that mate with one another to assure positive electrical contact between the core and the shells. It will be apparent that the swivel assembly shown provides for electrical continuity for the central conductor b/b' of the cord shown, and that the cord segments 20*a* and 20*b* and their associated outer shells 22 and 24 respectively are free to rotate with respect to one another while maintaining electrical continuity between the cord conductors in the swivel assembly.

Figure 2:
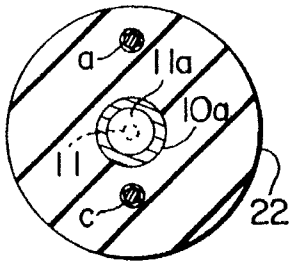
FIG. 2 is a sectional view taken generally on the line 2—2 of FIG. 1.
Figure 3:
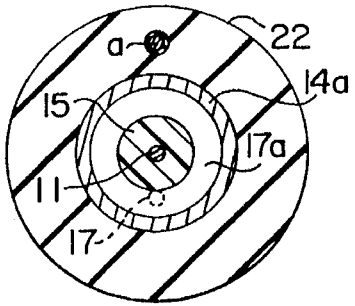
FIG. 3 is a sectional view taken generally on the line 3—3 of FIG. 1.
Figure 4:
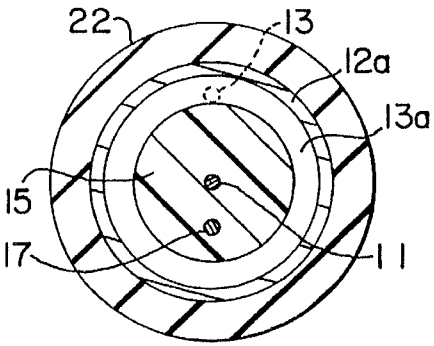
FIG. 4 is a sectional view taken generally on the line 4—4 of FIG. 1.

In order to provide an electrical path for the conductors a and c to connect them with the conductors a' and c' respectively, the conductor a is molded into the outer shell 22 and mates with an annular ring 12*a* also molded into the shell 22 as best shown in FIG. 4. A similar ring 12*b* is molded in the opposite shell 24. These rings 12*a* and 12*b* are electrically connected to one another by annular flanges 13*a* and 13*b* provided at opposite ends of another conductive element 13 provided for this purpose in the core 15. As so constructed and arranged electrical continuity is provided between the conductor a of cord segment 20*a* and conductor a' of cord segment 20*b*. Here again, rotation of these shells 22 and 24 with respect to one another and with respect to the core 15 is provided for without sacrifice to this electrical continuity.

In the three cord version of the invention shown the third conductor c is connected to its corresponding conductor c' by a somewhat smaller annular ring 14*a* that engages an annular surface 17*a* and is in turn connected by conductors 17 to a similar ring 17*b* that engages annular ring 14*b*. Conductor c' is connected electrically with conductor c in the same manner as described previously with reference to the conductors a and a'.

In light of the above, it should be understood that within the scope of the following claims, the invention may be practiced otherwise than as specifically described herein. The term multi-conductor is intended to convey the concept that any number of conductors might be provided in a cable in accordance with providing such a cable with a swivel assembly in accordance with the present invention.

I claim:

1. A swivel assembly for a multi-conductor cord, said assembly comprising a pair of outer shells, said shells being aligned on a common axis and provided in opposed relationship to one another, each shell having a central conductor terminal and at least one annular terminal for another conductor spaced radially and axially from said central conductor terminal, a core rotatably received on said aligned shell axes and having a central conductive element electrically connecting said central conductor terminals of said shells, said core also having at least one conductive element spaced radially from said central conductive element, and conductive annular slip rings electrically connected to the opposite ends of said at least one conductive element for mating with said annular terminals of said shells during rotational movement of said core relative to said shells.

2. The swivel assembly of claim 1 wherein said core has a stepped cylindrical outer contour, and wherein said annular slip rings define corners that include both radially and axially extending conductive surfaces.

3. The swivel assembly of claim 2 wherein said shells have inside surfaces of stepped cylindrical contour and wherein said annular terminals define corners that include both radially and axially extending conductive surfaces.

* * * * *